United States Patent [19]

Beatenbough et al.

[11] Patent Number: 4,545,636

[45] Date of Patent: Oct. 8, 1985

[54] METHODS OF AND ASSEMBLIES FOR STRAIN RELIEVING CONNECTORIZED FLAT CABLE

[75] Inventors: Charles M. Beatenbough, Buford, Ga.; William A. Elliott, Reynoldsburg, Ohio

[73] Assignee: AT&T Technologies, Inc., New York, N.Y.

[21] Appl. No.: 584,365

[22] Filed: Feb. 29, 1984

[51] Int. Cl.[4] ..... H01R 13/585

[52] U.S. Cl. ..... 339/105

[58] Field of Search ..... 339/17 F, 176 MF, 105

[56] References Cited

U.S. PATENT DOCUMENTS

| | | | |
|---|---|---|---|
| 3,102,767 | 9/1963 | Schneck | 339/105 X |
| 3,255,429 | 6/1966 | Forney | 339/105 X |
| 3,997,234 | 12/1976 | Worman | 339/105 |
| 4,111,512 | 9/1978 | Parmer et al. | 339/105 |
| 4,167,301 | 9/1979 | Mundschenk | 339/105 |
| 4,192,571 | 3/1980 | Strautz | 339/103 M |
| 4,270,832 | 6/1981 | Tanabe | 339/105 |
| 4,323,295 | 4/1982 | Davis | 339/107 |

FOREIGN PATENT DOCUMENTS

| | | | |
|---|---|---|---|
| 137170 | 8/1979 | German Democratic Rep. | 339/105 |

*Primary Examiner*—Eugene F. Desmond

*Attorney, Agent, or Firm*—H. St. Julian; R. P. Miller; M. de Picciotto

[57] ABSTRACT

A base housing unit (32), which supports a connector (48) on a bottom wall (40) thereof, includes a vertical boss (46) spaced from the connector to provide a cable receiving recess (70). An elongated slot (42) is formed through the vertical boss (46). A first end section of a flat cable (10), having accordion pleat sections (64, 66 and 68) formed therein, is threaded through the elongated slot (42). The pleat sections (64, 66 and 68) are positioned within the recess (70) and the first end section of the cable (10) is terminated on the connector (48). A cover (50) is then secured to the base housing unit (32). In response to the application of tension to a free end of the cable (10), the pleat sections (64, 66 and 68) flex to bind the cable between the connector (48) and the cover (50).

6 Claims, 5 Drawing Figures

METHODS OF AND ASSEMBLIES FOR STRAIN RELIEVING CONNECTORIZED FLAT CABLE

FIELD OF THE INVENTION

This invention relates to methods of and assemblies for providing strain relief for flat cable and, in particular, to methods of and assemblies for providing strain relief for flat cable terminated in a connector assembly without using auxiliary parts.

BACKGROUND OF THE INVENTION

In connectorizing flat cable having a plurality of laterally disposed conductors arranged in either a single parallel array or multiple parallel arrays, it is imperative that ends of conductors which are terminated in a connector be isolated from any detrimental tension forces. Such forces can lead to impaired cable conductor-connector contact connections or open-circuits. These forces may be imparted on a connectorized length of cable during the reeling or de-reeling thereof and in the installation in electrical equipment or in buildings. Thus, some form of strain relief must be employed in order to insure the integrity of established interconnections.

One technique for providing strain relief for flat cable is to thread an end portion through two or more openings or slots formed in an auxiliary plate projecting from a connector housing. The cable is threaded in a serpentine path through the slots so that, when the cable is pulled, edges of the slots bite into the cable and exert forces on the cable anchoring it therein preventing longitudinal movement thereof. This form of strain relief isolates electrical connections between ends of cable conductors and the connector from detrimental tension forces during normal handling of the connectorized cable. One form of this type of cable strain relief is disclosed in U.S. Pat. No. 3,997,234 which issued to J. N. Worman.

A disadvantage of the serpentine-path type of strain relief is that it is often difficult to thread an end portion of the cable through the slots due to the degree of stiffness and thickness of the cable. Additionally, it is difficult to determine initially how much of a terminated-end portion of the cable should be threaded through the slots so that the normally stripped ends of the conductors may be brought into an aligned relationship with the respective connector receptacles or contacts.

SUMMARY OF THE INVENTION

The present invention contemplates, among other things, assemblies for and methods of providing an electrical device with a strain relief arrangement for terminated flat cable which contemplates folding the cable in a manner such that when a force is applied to a free end thereof, the cable binds itself within the arrangement without imparting any of the applied force to the terminated end portions of the cable.

More particularly, a base housing unit supports a connector orthogonally on a bottom wall thereof. The base housing further includes a vertical boss formed therewith which is spaced from said connector to provide a cable receiving recess. An elongated slot is formed through the bottom wall between said connector and opens into the recess. A first end section of said cable is threaded through the elongated slot. The threaded section of the cable is deformed to form a pair of spaced permanent creases to provide three accordion pleat sections. A plurality of conductor end portions of the cable are terminated on the connector. The pleat sections are positioned within the recess and a cover is secured to said base housing unit. In response to the application of tension to said free end of said cable, first and second pleat sections flex to move a first crease positioned between first and second pleat sections into binding engagement with said connector and a second crease into binding engagement with a wall of said cover. This binding action of said cable prevents the transmission of the tension to the terminated conductor end portions.

BRIEF DESCRIPTION OF THE DRAWINGS

Other advantages and features of the invention will be apparent upon consideration of the following detailed description in conjunction with drawings wherein.

DETAILED DESCRIPTION

Figure 1:
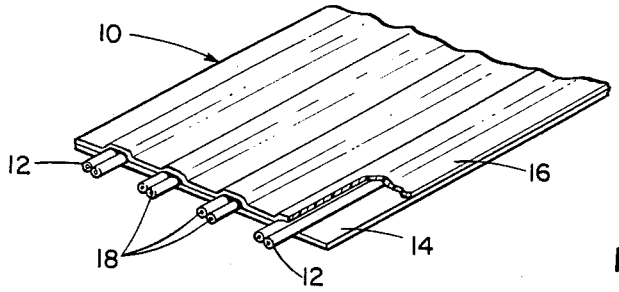
FIG. 1 is a perspective view of a section of flat cable.

Referring to FIG. 1, there is shown a portion of a flat cable designated generally by the numeral 10. Cable 10 includes a planar array of pairs of insulated conductors 12 which are positioned and laminated between two outer layers 14 and 16 of plastic material. The flat cable 10 is constructed of plastic material, e.g. polyetheyelene terephthalate, one form sold under the trademark MYLAR plastic film (registered trademark of the E. I. duPont de Nemours Co.), that is relatively stiff but possesses a degree of flexibility and is deformable to permit permanent creases to be imparted to the cable. Moreover, cable 10 has portions of the outer layers 14 and 16 stripped away which exposes end portions 18 of the insulated conductors 12 in order to enable the subsequent termination of the cable.

Figure 2:
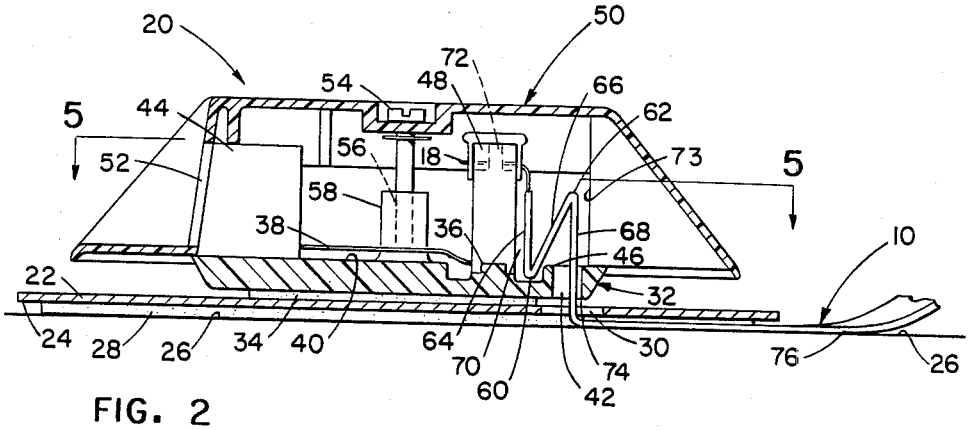
FIG. 2 is a sectional view of a station-end connector assembly and a strain relieved flat cable embodying certain principles of the invention.
Figure 5:
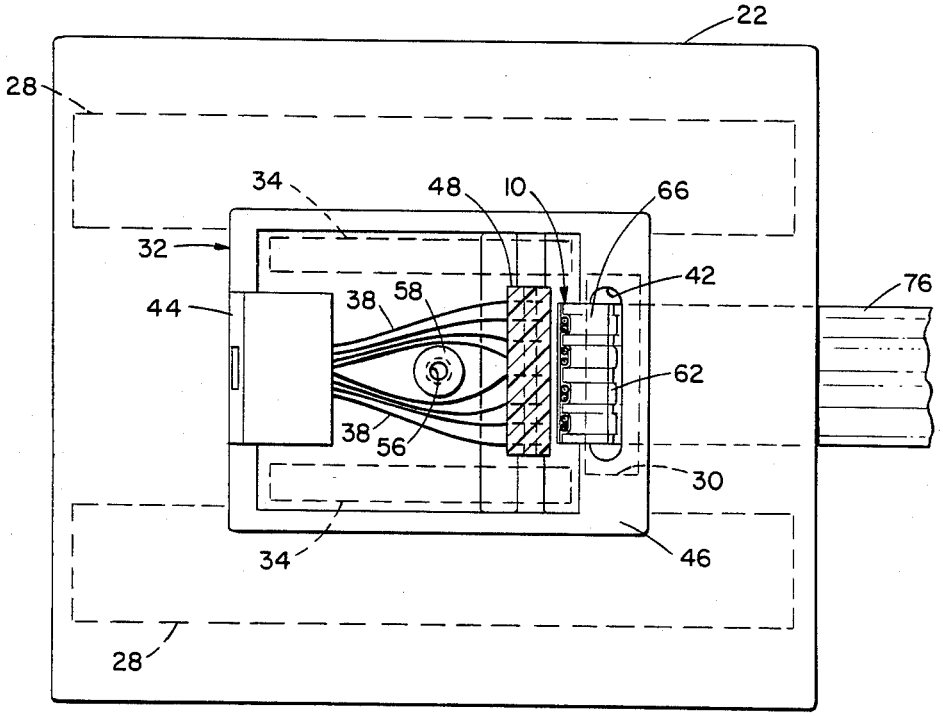
FIG. 5 is a sectional top view of the assembly of FIG. 2.

Referring to FIGS. 2 and 5, there are shown sectional views of a telephone station-end connector assembly designated generally by the numeral 20. The connector assembly 20 includes a base member or floor plate 22 having a first major surface 24 which may be attached to a floor surface 26 by an adhesive medium such as a first pair of spaced parallel strips of foam tapes 28 that are adhesive coated on both major surfaces. A transversely extending slot 30 is formed through the base member 22. The slot opens into the space between the parallel strips of adhesive coated foam tape 28.

A base housing unit, designated by the numeral 32, is attached to the base member 22 by a second pair of spaced parallel strips of adhesive coated foam tape 34. An index or slotted fanning strip 36, which enables the termination of a plurality of conductors 38 coupled to a standard telephone modular jack 44, is mounted on an upper surface 40 of the base housing unit 32. An elongated slot 42 is formed through a vertical boss 46 which extends the base housing unit 32 and is spaced from the slotted fanning strip 36. Moreover, the elongated slot 42 is located above and aligned with the elongated slot 30 formed in the base member 22. An insulation piercing connector 48 is mounted on the fanning strip 36 and enables the termination of the end portions 18 of the conductors 12.

A cover, designated generally by numeral 50, is positioned onto and removably secured to the base housing unit 32. The cover 50 includes an opening 52 formed therein which is aligned with and allows access to the telephone modular jack 44. The cover 50 is secured to the base housing unit 32 by a screw 54 which is seated within a tapped bore 56 formed in a post 58 extending upwardly from the base member 22.

Figure 3:
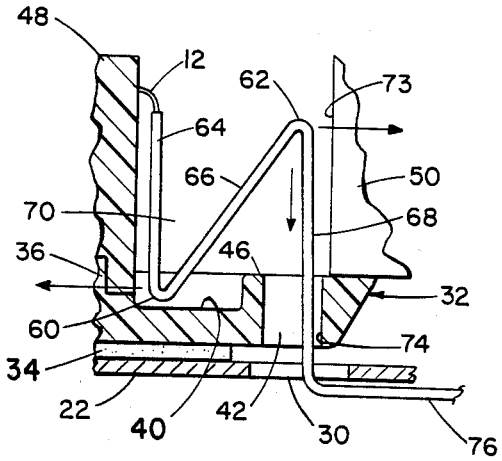
FIG. 3 is an enlarged view of a portion of FIG. 2 illustrating a folded cable section interposed between a connector and a wall of a cover.
Figure 4:
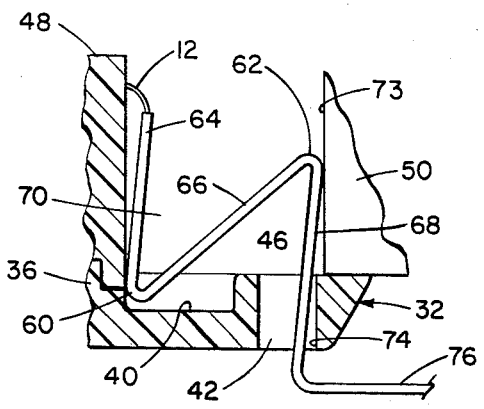
FIG. 4 is similar to FIG. 3 and illustrates the cable flexed to engage the connector and the wall of the cover.

In use, with the cover 50 removed and referring to FIGS. 2, 3 and 4, an operator threads a first or leading end section of cable 10 through the transverse elongated slots 30 and 42 of the assembly 20. The operator then deforms the first end portion of the cable 10 using a plier-like tool (not shown) or by hand to form a pair of permanent creases 60 and 62 across the width thereof and first, second and third successive flexible accordion pleat sections 64, 66 and 68, respectively. The pleat sections 64 and 66 are positioned within a recess 70 which is formed between the fanning strip 36 and the boss 46 of the base housing unit 32 so that crease 60 is positioned adjacent to the upper surface 40 of the base housing unit. The length of the first pleat section 64 must be such that end portions 18 of the conductors 12 are positioned adjacent to and aligned with the insulation piercing connector contacts 72 of the connector 48 when crease 60 is positioned adjacent to the upper surface 40 of the base housing unit 32. The end portions 18 are then pressed and terminated into the insulation piercing connector contacts 72. The assembly 20 is adhesively secured to a selected position on the floor surface 26 such that the portion of the cable 10 which extends from the elongated slot 30 is positioned between the parallel strips of the adhesive coated foam tapes 28.

As noted above, cable 10 is relatively stiff but possesses a degree of flexibility. Thus, when tension is applied to a second or unterminated end portion 76 of cable 10, the second and third pleat sections 66 and 68, respectively, flex to move crease 60 downwardly into sliding engagement along the bottom surface 40 of recess 70 and ultimately into binding engagement against a bottom section of a side wall of the connector 48. As tension continues to be applied to the second end portion 76 of cable 10, the third pleat section 68 continues to move in a downward direction through the elongated slot 42 while the second pleat section 66 pivots about crease 60 and moves crease 62 in a direction away from the connector 48 and into binding engagement with an internal wall surface 73 of the cover 50. The movement of crease 62 moves a lower section of the third pleat section 68 into binding engagement with an edge 74 of the elongated slot 42. The stiffness of the second pleat section 66 enables this section to be placed in longitudinal compression due to the binding engagements of creases 60 and 62 and, thus, acts as a bridging wedge between first and third pleat sections 64 and 68, respectively, as long as the tension is being applied to the second end portion 76 of cable 10. Ultimately, the wedging action of the second pleat section 66 prevents the transmission of the tension, which is being applied to the second end 76 of cable 10, to the end portions 18 terminated within connector 48. Thus, the binding of cable 10 within the assembly 20 isolates the end portions 18 from the tension being applied to the second end 76 of the cable.

Another important feature of assembly 20 is that strain relief is maintained for the connected end of the cable 10 when the cover 50 is removed for servicing of the assembly. As noted above, when a pulling force is applied to the second end portion 76 of cable 10, the second and third pleat sections 66 and 68, respectively, flex to move crease 60 downwardly and into binding engagement against the bottom section of the side wall of the connector 48. The third pleat section 68 moves in a downward direction through the elongated slot 42 while the second pleat section 66 pivots about crease 60. The stiffness of the second pleat section 66 moves crease 62 in a direction away from the connector 48 which ultimately moves the third pleat section 68 into binding engagement with the edge 74 of the elongated slot 42. Moreover, the stiffness of the second pleat section 66 enables this section to be placed in longitudinal compression due to the binding engagement of crease 60 and the downward movement of the third pleat section 68.

In summary, the third pleat section 68 moves downward in response to the application of tension to the second end portion 76 of cable 10. The second pleat section 66 (1) flexes to move the first pleat section 64 toward the side wall of the connector 48 and crease 60 into binding engagement with the bottom wall section of the connector and (2) pivots about crease 60 and forces crease 62 in the direction away from the connector 48 and into binding engagement with the inner vertical wall 73 of the cover 50. Due to the stiffness of cable 10, the second pleat section 66 is placed in longitudinal compression and the lower section of the third pleat section 68 is moved into engagement with edge 74 of elongated slot 42 of the base housing unit 32 by the movement of the crease 62. Ultimately, the third pleat section 68 binds itself against edge 74 as a result of the force exerted thereon by the second pleat section 66 which is wedged between the first and third pleat sections, 64 and 68, respectively, and which thereafter prevents any further movement of the third pleat section through the elongated slot 42.

What is claimed is:

1. A method of strain relieving a flat flexible cable to be terminated to a connector mounted a base housing unit having an elongated slot formed in a bottom wall of the housing, which comprises:

passing a leading end section of said flat cable through said elongated slot;

deforming said leading end section of said cable to form a pair of permanent creases and three successive flexible accordion pleat sections;

positioning said pleat sections within the base housing unit between said slot and said connector; and flexing said pleat sections in response to tension applied to the cable by first moving a first of said pleat sections and a first crease formed between the first and a second pleat sections toward the connector to press the first crease into binding engagement with said connector, and then moving a third pleat section into binding engagement with an edge of said slot thereby relieving strain from the connector-terminated end of the cable.

2. The method as recited in claim 1 wherein said cable includes a plurality of conductors and which further comprises the step of terminating ends of each of the conductors to said connector so that said first pleat section will be positioned adjacent to said connector when said pleat sections are positioned within said base housing unit.

3. A method as recited in claim 2 further comprising the step of mounting on said housing a cover having an internal cover wall spaced from said connector so that a second crease formed between said second and third pleat sections moves away from the connector into binding engagement with said cover wall in response to the continued application of tension to said cable thereby placing said second pleat section in a longitudinal compression mode between the two creases.

4. An assemblage having strain relief capabilities for a flat cable, which comprises:

a base having an elongated slot formed therethrough;

a first member mounted on said base and having a first vertically extending wall spaced from said slot; and a leading section of said flat cable extending through said slot and creased at two spaced locations to form three successive flexible accordion pleat sections with a pair of permanent creases therebetween, said flexible pleat sections being movably positioned between the first member and the slot with a first of said pleat sections having a first end connected to said first member and being of sufficient length to abut a first crease against said first wall along a line adjacent to the juncture of the first wall with said base when a pulling force is initially applied to said cable, and with a second of said pleat sections being of sufficient length to pivot about said abutted first crease to abut a third of said pleat sections against an edge of said slot upon continued application of said pulling force to provide a strain relief for the connected end of said cable against the continued application of the pulling force to the cable.

5. The assemblage as set forth in claim 4 further comprises a second member secured to said base, said second member having a second vertically extending wall spaced from and facing said first wall and wherein a second crease, in response to the continued application of said pulling force, is abutted against said second wall to provide said strain relief.

6. A strain relief assemblage of a connector and a flat cable, which comprises:

a base housing unit for supporting orthogonally said connector and having an elongated slot for receiving a leading end section of the flat cable;

a cover mounted on said base housing unit and having a side wall spaced from said connector to provide a cable receiving recess therebetween, said recess being located above the elongated slot;

said leading end section of said cable having a pair of permanent creases formed thereacross to provide three successive flexible accordion pleat sections movably positioned within said recess such that a first of said creases is abutted against a lower section of said connector, a second of said creases is abutted against said side wall, and the pleat section entering said slot is abutted against an edge of said slot; and means for terminating the pleat section running from said first crease to the end of the cable in said connector.

* * * * *